US005827633A

United States Patent [19]

Ong et al.

[11] Patent Number: 5,827,633

[45] Date of Patent: Oct. 27, 1998

[54] TONER PROCESSES

[75] Inventors: Beng S. Ong, Mississauga; Raj D. Patel, Oakville, both of Canada

[73] Assignee: Xerox Corporation, Stamford, Conn.

[21] Appl. No.: 903,694

[22] Filed: Jul. 31, 1997

[51] Int. Cl.[6] ..... G03G 9/097

[52] U.S. Cl. ..... 430/137

[58] Field of Search ..... 430/137

[56] References Cited

U.S. PATENT DOCUMENTS

| | | | |
|---|---|---|---|
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,066,560 | 11/1991 | Tan et al. | 430/137 |
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,364,729 | 11/1994 | Kmiecik-Lawrynowicz et al. | 430/137 |
| 5,370,963 | 12/1994 | Patel et al. | 430/137 |
| 5,403,693 | 4/1995 | Patel et al. | 430/137 |
| 5,418,108 | 5/1995 | Kmiecik-Lawrynowicz et al. | 430/137 |

*Primary Examiner*—Roland Martin

*Attorney, Agent, or Firm*—E. O. Palazzo

[57] ABSTRACT

A process for the preparation of toner comprising (i) preparing, or providing an aqueous colorant dispersion, which dispersion is comprised of a colorant and an ionic surfactant in water;

(ii) blending said colorant dispersion with a latex emulsion comprised of resin particles, a nonionic surfactant, and an ionic surfactant of opposite charge polarity to that of the ionic surfactant in said colorant dispersion;

(iii) heating the resulting mixture below about the glass transition temperature (Tg) of the latex resin to form toner sized aggregates;

(iv) heating the resulting aggregate suspension of (iii) above about the Tg of the latex resin; and (v) retaining the temperature in the range of from about 30° C. to about 95° C., and subsequently, adding an aqueous solution of boric acid, or an aqueous solution of a metal salt; adjusting the pH of the resulting reaction mixture to from about 9 to about 12 by the addition of a base, followed by the addition of a salicylic acid or catechol; and optionally (vi) isolating, washing and drying the toner obtained.

22 Claims, No Drawings

TONER PROCESSES

BACKGROUND OF THE INVENTION

The present invention is generally directed to toner processes, and more specifically, to chemical processes which involve the aggregation and fusion of latex, colorant, such as pigment, and additive particles into toner particles, and wherein certain charge enhancing entities, or agents are generated in situ and are chemically bound to the surface of the toners obtained. In embodiments, the present invention is directed to chemical processes for obtaining toners wherein the toner surface is chemically modified to provide suitable charging characteristics, and in embodiments toner compositions with a volume average diameter of from about 1 to about 15 microns, and preferably from about 2 to about 10 microns with a narrow particle size distribution as conventionally characterized by GSD of, for example, less than or equal to about 1.35, and preferably less than about 1.25, and more specifically, from about 1.13 to about 1.25 as measured on the Coulter Counter. The resulting toners can be selected for known electrophotographic imaging and printing processes, including digital color processes. In embodiments, with the processes of the present invention there are chemically bonded to the toner charge enhancing additive components, and thereby for example, the movement or migration of these components is eliminated, or minimized. The chemically bonding, or attachment can be achieved, for example, by the reaction of a carboxylic acid group, such as the carboxylic acid group of a poly(acrylic acid) or its copolymer with an appropriate charge enhancing additive precursor.

PRIOR ART

Numerous processes are known for toner preparation, such as, for example, conventional processes wherein a resin is melt blended or extruded with a pigment, micronized and pulverized to provide toner particles. The average volume particle diameter which can be cost-effectively produced by conventional processes are generally over 8 or 9 microns with a typical GSD of well over 1.4. In these conventional processes, it is therefore important to subject the toners to a size classification step to achieve a decreased GSD to an acceptable GSD of, for example, about 1.35 to thereby provide reasonable image development quality. In general, two or more classification cycles may be required, and the toner yields after classification can range from about 40 percent to about 90 percent depending on the toner size and GSD requirements. Also, generally, for toners with average particle size diameters of from about 11 microns to about 15 microns, the toner yields range from about 70 percent to about 85 percent after classification. For smaller sized toners such as about 7 or 8 micron toners, lower yields of about 50 to 80 percent can result after classification. With the processes of the present invention in embodiments, small toner sizes of, for example, from about 2 to about 7 microns, and GSD of less than about 1.35, and more specifically, less than about 1.25 can be obtained without the classification processes. Since no classification is involved in embodiments, small toner sizes of from about 2 microns to about 7 microns can be economically prepared in yields of over 90 percent.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention does not need to utilize polymer polar acid groups, and toners can be prepared with resins, such as poly(styrene-butadiene) or PLIOTONE™, containing no polar acid groups. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD, are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

Emulsion/aggregation processes for the preparation of toners with optional charge control additives are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,346,797, U.S. Pat. No. 5,370,963, U.S. Pat. No. 5,344,738, U.S. Patent 5,403,693, U.S. Pat. No. 5,418,108, U.S. Pat. No. 5,364,729, and U.S. Patent 5,346,797.

SUMMARY OF THE INVENTION

Examples of objects of the present invention in embodiments thereof include:

It is an object of the present invention to provide toner processes with many of the advantages illustrated herein.

In another object of the present invention there are provided simple and economical processes for the preparation of black and colored toner compositions having toner size of, for example, from about 1 to about 15 microns in volume average diameter and narrow GSD of less than, or equal to about 1.35, and wherein the toners display controlled charging characteristics.

In another object of the present invention there are provided simple processes for black and colored toner compositions, which processes involve first aggregating and coalescing latex and colorant particles into toner particles, followed by chemically generating a charge enhancing functionality or moiety on the surface of the toner particles, thereby providing effective control over the charging characteristics of the resultant toners.

In a further object of the present invention there is provided a process for the preparation of toner compositions with an average particle volume diameter of from between about 1 to about 15 microns, and preferably from about 2 to about 7 microns, and a narrow GSD of less than about 1.35, and preferably less than about 1.25 as measured by a Coulter Counter.

A further object of the present invention is the provision of toner processes whereby toner compositions of about 1 to about 15 microns in volume average diameter and GSD of about 1.35, or less are obtainable by the aggregation and the coalescence of latex and colorant particles in the presence of suitable ionic and nonionic surfactants (aggregation/coalescence process), and wherein the surface of the toners is modified by the reaction of a salicylic acid and/or catechol with boric acid or a metal ion after coalescence.

In a further object of the present invention there is provided an aggregation/coalescence process for the preparation of toner compositions with certain effective particle sizes achieved by controlling the temperature of the aggregation, and which processes involve heating a mixture of latex and colorant particles in the presence of suitable surfactants at a temperature below the glass transition temperature (Tg) of the latex resin to form toner sized aggregates, followed by heating above the Tg to form mechanically stable toner particles.

In a further object of the present invention there is provided an aggregation/coalescence process for the preparation of toners with narrow particle size distribution as characterized by having a GSD less than about 1.35, and preferably less than about 1.25 as measured by the Coulter Counter, and which toners contain chemically bonded to the surface thereof charge additives.

Moreover, in a further object of the present invention there is provided a process for the preparation of toner compositions which after fixing to paper substrates provide image gloss values of from about 5 to over 70 GGU (Gardner Gloss Units) as measured by Gardner Gloss meter.

In still a further object of the present invention there is provided an aggregation/coalescence process for toner compositions of small particle size of from about 2 to about 7 microns in volume average diameter and GSD of less than 1.25 in overall process yields of from about 85 percent to over 95 percent without involving conventional size classification.

In yet another object of the present invention there are provided toner compositions with low fusing temperatures of from about 120° C. to about 180° C., which toner compositions also exhibit excellent toner blocking temperatures of over 45° C.

Moreover, in another object of the present invention there are provided toner compositions with excellent color mixing properties and high image projection efficiencies of in excess of about 70 percent as measured by the Match Scan II spectrophotometer available from Milton-Roy.

A further object of the present invention is the provision of small toner compositions which when fused on paper substrates do not lead to objectionable paper curl and image feel.

In another object of the present invention there are provided processes for the preparation of toner comprised of resin and pigment, and wherein the toner surface carries chemically attached charge controlling functionalities, and which toner can be of a preselected size, such as from about 1 to about 10 microns in volume average diameter, and with narrow GSD of less than 1.35, and more specifically, less than 1.25.

In embodiments of the present invention, there are provided processes for the preparation of toner by the aggregation of latex and colorant particles in the presence of suitable surfactants to form toner sized aggregates at a temperature below about the Tg of the latex resin, followed by coalescence of the components of the aggregates at a temperature about above the Tg of the resin to form mechanically robust toner particles, and wherein the aggregate size, and thus the toner size is controlled by the temperature at which the aggregation is conducted. During coalescence a stabilization agent which prevents the aggregates from growing in size with temperature is optionally, but preferably, added before the temperature is increased above the Tg of the resin. After coalescence, the reaction temperature is, for example, maintained at from about 40° C. to about 90° C. (Centigrade), and an aqueous solution of boric acid or an aqueous solution of metal salt is added. The pH of the reaction mixture is then adjusted to be, for example, equal to, or above about 9 with a base such as potassium hydroxide, followed by addition of a salicylic acid and/or catechol. The resulting mixture is maintained at this temperature with stirring at pH of above, for example, 9 for an effective period of time of, for example, from about 15 minutes to about seven hours before the toner particles are filtered, washed with water or aqueous alkali base, and then dried in an oven, a freeze dryer, spray dryer, or fluid bed.

In embodiments, the present invention is directed to aggregation/coalescence toner processes which comprises (i) blending an aqueous colorant dispersion containing a cationic surfactant, such as benzalkonium chloride with a latex emulsion containing an anionic surfactant such as sodium dodecylbenzene sulfonate with a homogenizer, thereby causing flocculation of latex and colorant particles primarily as a result of the destabilization caused by neutralization of oppositely charged surfactants; (ii) subsequently heating the resulting flocculent mixture at a temperature of about 30° C. to about 60° C., thereby inducing formation of toner sized aggregates comprised of latex particles, colorant particles and surfactants, and wherein the aggregate size is, for example, from about 2 microns to about 10 microns in volume average diameter with a GSD of less than about 1.35, and more specifically, from about 1.14 to about 1.25; (iii) effecting by heating coalescence of the components of the aggregates to form mechanically stable integral toner particles, which heating is accomplished in the presence of additional anionic surfactant, and which heating is at a temperature of from about 65° C. to about 100° C. for a duration of, for example, about 30 minutes to about 10 hours; (iv) maintaining the reaction temperature from about 40° C. to about 90° C., and adding an aqueous solution of boric acid or a metal salt, and then adjusting the pH of the reaction mixture to be above about 9, which pH is achievable with the addition of an alkali base such as potassium hydroxide, followed by addition of a salicylic acid or a catechol; and (v) isolating the toner. The boric acid, or metal of the metal salt reacts, for example, with carboxylic acid groups on the toner surface, followed by the reaction thereof with salicylic acid and/or catechol to provide surface chemically bound charge control entities.

The chemical treatment of the toner particles after coalescence (iv) is believed to result in the chemical attachment of the boron or metal ions from the metal salt onto the toner surface. The surface-bound boron or metal ions then react with the added salicylate or catecholate ions providing surface-bound charge controlling functionalities on the toner particles.

Examples of salicylic acids that can be selected for the reaction include 2-hydroxybenzoic acid, methylsalicylic acids, bromosalicylic acids, chlorosalicylic acids, iodosalicylic acids, 2-hydroxy-iso-phthalic acid, 3,5-dimethylsalicylic acid, 3,5-diethylsalicylic acid, 3,5-dipropylsalicylic acid, 3,5-dibromosalicylic acid, 3,5-chlorosalicylic acid, 3,5-iodosalicylic acid, 3,5-di-tert-butylsalicylic acid and the like; examples of catechols include dihydroxybenzene, methylcatechols, ethylcatechols, propylcatechols, 4-tert-butylcatechol; and examples of metal salts include zinc chloride, zinc bromide, zinc iodide, zinc nitrate, zinc sulfate, chromium chloride, chromium sulfate, aluminum chloride, aluminum bromide, aluminum sulfate, and the like. In general, equimolar quantities of a metal salt and a salicylic acid or a catechol are utilized in the reaction with the effective amounts of combined metal ion and salicylic acid or catechol being in the range of, for example, from about 0.1 to about 3 percent by weight of toner.

In embodiments, colorants, such as pigments, are available in the wet cake form or concentrated form containing water, can be easily dispersed in the presence of a suitable dispersant agent utilizing a homogenizer or stirring. Also, colorants, such as pigments, may be available only in a dry form, and thus usually are dispersed in water by microfluidizing using, for example, a M-110 microfluidizer and passing the pigment dispersion from 1 to 10 times through the chamber of the microfluidizer, or via sonication, such as using a Branson 700 sonicator. Suitable pigment dispersants include ionic or nonionic surfactants.

Illustrative examples of latex resins or polymers selected for the process of the present invention include known polymers such as poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and the like. The resin selected in embodiments is present in various effective amounts, such as from about 85 weight percent to about 98 weight percent, of from about 90 to about 95 weight percent of the toner, and the latex solids size can be of small particle size, such as from about 0.05 micron to about 1 micron in average volume diameter as measured by the Brookhaven nanosize particle analyzer. Other sizes and effective amounts of latex particles may be selected in embodiments.

The resin selected for the process of the present invention is preferably prepared by emulsion polymerization methods, and the monomers utilized in such processes include styrene, acrylates, methacrylates, butadiene, isoprene, acrylonitrile, acrylic acid, and methacrylic acid. Known chain transfer agents, for example dodecanethiol, in effective amounts of from about 0.1 to about 10 percent, and/or carbon tetrabromide in effective amounts of from about 0.1 to about 10 percent can also be employed to control the resin molecular weight during the polymerization. Other processes of obtaining resin particles of from, for example, about 0.05 micron to about 1 micron can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants, such as pigments, present in the toner in a suitable amount of, for example, from about 1 to about 15 percent by weight of the toner, and preferably in an amount of from about 3 to about 10 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue pigment or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta components that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan components that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a mono azo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention.

Colorants include pigments, dyes, mixtures thereof, mixtures of pigments, mixtures of dyes, and the like.

Surfactants in amounts of, for example, from about 0.01 to about 20, or more specifically from about 0.1 to about 15 weight percent of the reaction mixture in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example from about 0.01 to about 10 percent by weight, and preferably from about 0.1 to about 5 percent by weight of reaction mixture.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of reaction mixture.

Examples of the cationic surfactants selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.01 percent to about 5 percent by weight of reaction mixture. Preferably, the molar ratio of the cationic surfactant used for flocculation to the anionic surfactant used in the latex preparation is in the range of from about 0.5 to about 4, and preferably from about 0.5 to about 2.

Examples of the additional surfactant, which is added to the aggregate suspension during the coalescence step to prevent the aggregates from growing in size, or for stabilizing the aggregate size with increasing temperature, can be selected from anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. These surfactants can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant generally employed as an aggregate size stabilization agent is, for example, from about 0.01 to about 10 percent by weight, and preferably from about 0.1 to about 5 percent by weight of the reaction mixture.

Surface additives that can be added to the toner compositions to, for example, improve their powder flow properties include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various pieces of the present invention. These Examples are intended to be illustrative only and are not intended to limit the scope of the present invention. Percentages are by weight unless otherwise indicated. Comparative Examples and data are also provided.

EXAMPLE I

A solution was prepared by mixing an aqueous solution of 6.0 grams of ammonium persulfate in 200 milliliters of water with 700 milliliters of an aqueous solution of 13.5 grams of anionic surfactant, NEOGEN R™ (which contains 60 weight percent of active sodium dodecyl benzene sulfonate in water) and 12.9 grams of ANTAROX 897™ (which contains 70 weight percent of active polyoxyethylene nonyl phenyl ether in water). A mixture of 492.0 grams of styrene, 108.0 grams of butyl acrylate, 12.0 grams of acrylic acid, 6 grams of carbon tetrabromide and 18.0 grams of dodecanethiol was added to the prepared aqueous solution, and the resulting mixture was homogenized at room temperature, about 25° C. throughout, under a nitrogen atmosphere at about 20° C., for 30 minutes. Subsequently, the mixture was heated to 70° C. at a rate of 1° C. per minute, and maintained at this temperature for 6 hours. The resulting latex polymer evidenced an $M_w$ of 25,900, an $M_n$ of 5,300, and a Tg (glass transition temperature) of 56.1° C.

260.0 Grams of the above prepared latex emulsion and 220.0 grams of an aqueous cyan pigment dispersion containing 4.0 grams of the Cyan Pigment 15.3 and 2.6 grams of cationic surfactant, SANIZOL B™, were simultaneously added to 400 milliliters of water with high shear stirring using a polytron. The resulting mixture was transferred to a 2 liter reaction vessel and heated at a temperature of 50° C. for 1.0 hour before 45 milliliters of 20 percent aqueous NEOGEN R™ solution were added. Subsequently, the mixture was heated to 93° C. (Centigrade throughout) and retained at about 93° C. for a period of 4 hours before cooling down the mixture to about 50° C. After addition of 2.20 grams of zinc sulfate heptahydrate, the pH of the reaction mixture was adjusted to be about 10 by the addition of an aqueous potassium hydroxide solution before a solution of 1.92 gram of 3,5-di-tert-butylsalicylic acid and 1.0 gram of 85 percent potassium hydroxide in 45 milliliters of water was added. The reaction mixture was stirred at 85° C. for one hour and filtered. The toner was washed four times with water and dried in a freeze dryer. The resulting toner, which was comprised of resin, pigment, and on the toner surface the charge control functionality derived from the reaction of the zinc sulfate and 3,5-di-tert-butylsalicylic acid, showed a particle size of 6.8 microns in volume average diameter and a GSD of 1.21 as measured with a Coulter Counter.

The toner charging evaluation was performed according to the following procedure. In a 120 milliliter glass bottle, 1 gram of the prepared toner was added to 24 grams of carrier particles comprised of 65 micron steel core particles coated with a mixture of 20 percent by weight of VULCAN™ carbon black dispersed in 80 percent of poly(methyl methacrylate), and wherein the carrier coating weight was 1 percent. Samples of the toner and carrier were retained in an environmental chamber at either 20 or 80 percent relative humidity for about 18 hours. The bottle was then sealed, and the contents were mixed by roll milling for 30 minutes to obtain a stable triboelectric charge. The toner charge was measured using the standard Faraday Cage tribo blow-off apparatus. For the toner of this Example, the tribo values at 20 and 80 percent relative humidity were, respectively, −25.4 and −13.2 microcoulombs per gram ($\mu$C/g).

COMPARATIVE EXAMPLE A

A comparative toner was prepared in accordance with the procedure of Example I except that the toner was not subjected to the reaction with zinc sulfate and 3,5-di-tert-butylsalicylic acid. The toner evidenced a particle size of 7.0 microns in volume average diameter and a GSD of 1.21. Evaluation of the toner in accordance with the procedure of Example I provided tribo values of −11.7 $\mu$C/g and −5.1 $\mu$C/g at, respectively, 20 and 80 percent relative humidity, or at significantly lower charging levels than the toner of Example I.

EXAMPLE II 260.0 Grams of the latex emulsion as prepared in Example I and 220.0 grams of an aqueous yellow pigment dispersion containing 9.3 grams of Pigment Yellow 17 and 2.6 grams of cationic surfactant SANIZOL B™ were simultaneously added to 400 liters of water with high shear stirring by means of a polytron. The mixture was transferred to a 2 liter reaction vessel and heated at a temperature of 50° C. for 1.5 hour before 60 milliliters of 20 percent aqueous NEOGEN R™ solution were added. Subsequently, the resulting mixture was heated to 95° C. and retained there for a period of 4 hours before cooling down to about 50° C. After the addition of 2.20 grams of zinc sulfate heptahydrate, the pH of the reaction mixture was adjusted to be about 9 by the addition of aqueous potassium hydroxide solution before a solution of 1.92 gram of 3,5-di-tert-butylsalicylic acid and 1.0 gram of 85 percent potassium hydroxide in 45 milliliters of water was added. The reaction mixture was stirred at 85° C. (Centigrade throughout) for one hour and filtered. The toner was washed four times with water and freeze dried. The resulting toner which was comprised of resin, pigment, and on the toner surface, and functioning primarily as a charge control agent throughout, charge control entities derived from the reaction of zinc sulfate and 3,5-di-tert-butylsalicylic acid, showed a particle size of 6.6 micron in volume average diameter and a GSD of 1.19 as measured with a Coulter Counter. The tribo values of this yellow toner as evaluated according to the procedure of Example I were −16.8 $\mu$C/g and −7.2 $\mu$C/g at, respectively, 20 and 80 percent relative humidity as compared to the yellow toner of Comparative Example B wherein the tribos were −7.1 $\mu$C/g and −3.1 $\mu$C/g).

COMPARATIVE EXAMPLE B

A comparative toner was prepared in accordance with the procedure of Example II except that the toner was not subjected to the reaction with zinc sulfate and 3,5-di-tert-butylsalicylic. This toner evidenced a particle size of 6.8 microns in volume average diameter and a GSD of 1.22. Evaluation of the toner in accordance with the procedure of Example I provided tribo values of −7.1 $\mu$C/g and −3.1 $\mu$C/g at, respectively, 20 and 80 percent relative humidity.

EXAMPLE III 260.0 Grams of the latex emulsion as prepared in Example I and 220.0 grams of an aqueous carbon black dispersion containing 6.7 grams of REGAL 330® carbon black and 2.6 grams of the cationic surfactant SANIZOL BTM were simultaneously added to 400 milliliters of water with high shear stirring by means of a polytron. The mixture was transferred to a 2 liter reaction vessel and heated at a temperature of 50° C. for 1.5 hour before 45 milliliters of 20 percent aqueous NEOGEN R™ solution were added. Subsequently, the mixture was heated to 93° C. and held there for a period of 4 hours before cooling down to about 50° C. After the addition of 2.20 grams of zinc sulfate heptahydrate, the pH of the reaction mixture was adjusted to be about 10 by the addition of aqueous potassium hydroxide solution before a solution of 1.92 grams of 3,5-di-tert-butylsalicylic acid and 1.0 gram of 85 percent potassium hydroxide in 45 milliliters of water was added. The resulting reaction mixture was stirred at 85° C. for one hour and filtered. The toner was washed four times with water and freeze dried. The resulting toner, which was comprised of resin, pigment, and on the toner surface certain charge control entities, and which functions primarily as a charge control agent, derived from the reaction of zinc sulfate and 3,5-di-tert-butylsalicylic acid, evidenced a particle size of 6.7 microns in volume average diameter and a GSD of 1.18 as measured with a Coulter Counter. The tribo values of the toner as evaluated according to the procedure of Example I were −19.9 $\mu$C/g and −8.2 $\mu$C/g at, respectively, 20 and 80 percent relative humidity.

COMPARATIVE EXAMPLE C

A comparative toner was prepared in accordance with the procedure of Example III except that the toner was not subjected to the reaction with zinc ion and 3,5-di-tert-butylsalicylic acid. The toner evidenced a particle size of 6.9 microns in volume average diameter and a GSD of 1.20. Evaluation of the toner in accordance with the procedure of Example I provided tribo values of −9.8 $\mu$C/g and −5.3 $\mu$C/g at, respectively, 20 and 80 percent relative humidity.

EXAMPLE IV 260.0 Grams of the latex emulsion as prepared in Example I and 220.0 grams of an aqueous magenta pigment dispersion containing 5.5 grams of Pigment Red 81.3 and 2.6 grams of the cationic surfactant SANIZOL B™ were simultaneously added to 400 milliliters of water with high shear stirring by means of a polytron. The mixture was transferred to a 2 liter reaction vessel and heated at a temperature of 50° C. for 1.5 hours before 45 milliliters of a 20 percent aqueous NEOGEN R™ solution were added. Subsequently, the resulting mixture was heated to 95° C. and retained there for a period of 4 hours before cooling down to about 50° C. After the addition of 2.20 grams of zinc sulfate heptahydrate, the pH of the reaction mixture was adjusted to be about 10 by the addition of an aqueous potassium hydroxide solution before a solution of 1.92 grams of 3,5-di-tert-butylsalicylic acid and 1.0 gram of 85 percent potassium hydroxide in 45 milliliters of water was added. The reaction mixture was stirred at 85° C. for one hour and filtered. The toner was washed four times with water and freeze dried. The resulting toner comprised of resin, pigment, and on the toner surface and functioning primarily as a charge control agent, charge control entities derived from the reaction of zinc sulfate and 3,5-di-tert-butylsalicylic acid, evidenced a particle size of 6.9 microns in volume average diameter and a GSD of 1.19 as measured with a Coulter Counter. The tribo values of the toner as evaluated according to the procedure of Example I were −20.2 μC/g and −7.8 μC/g at, respectively, 20 and 80 percent relative humidity.

COMPARATIVE EXAMPLE D

A comparative toner was prepared in accordance with the procedure of Example IV except that the toner was not subjected to the reaction with zinc sulfate and 3,5-di-tert-butylsalicylic acid. The toner showed a particle size of 6.7 microns in volume average diameter and a GSD of 1.17. Evaluation of the toner in accordance with the procedure of Example I provided tribo values of −10.6 μC/g and −5.9 μC/g at, respectively, 20 and 80 percent relative humidity.

EXAMPLE V 260.0 Grams of the latex emulsion and 220.0 grams of an aqueous cyan pigment dispersion containing 4.0 grams of Cyan Pigment 15.3 and 2.5 grams of cationic surfactant SANIZOL B™ were simultaneously added to 400 milliliters of water with high shear stirring by means of a polytron. The mixture was transferred to a 2 liter reaction vessel and heated at a temperature of 50° C. for 1.5 hour before 45 milliliters of 20 percent aqueous NEOGEN R™ solution were added. Subsequently, the mixture was heated to 93° C. and held there for a period of 4 hours before cooling down to about 50° C. After addition of 2.20 grams of zinc sulfate heptahydrate, the pH of the reaction mixture was adjusted to be about 10 by addition of aqueous potassium hydroxide solution before a solution of 1.16 gram of methylsalicylic acid and 1.0 gram of 85 percent potassium hydroxide in 45 milliliters of water was added. The reaction mixture was stirred at 85° C. for one hour and filtered. The toner was washed four times with water and freeze dried. The resulting toner comprised of resin, pigment, and on the toner surface and functioning primarily as a charge control agent, charge control entities derived from the reaction of zinc sulfate and methylsalicylic acid, evidenced a particle size of 6.5 microns in volume average diameter and a GSD of 1.23 as measured with a Coulter Counter. The tribo values of the toner as evaluated according to the procedure of Example I were −24.5 μC/g and −12.8 μC/g at, respectively, 20 and 80 percent relative humidity.

EXAMPLE VI 260.0 Grams of the latex emulsion and 220.0 grams of an aqueous cyan pigment dispersion containing 4.0 grams of the Cyan Pigment 15.3 and 2.5 grams of cationic surfactant SANIZOL B™ were simultaneously added to 400 milliliters of water with high shear stirring by means of a polytron. The mixture was transferred to a 2 liter reaction vessel and heated at a temperature of 50° C. for 1.5 hour before 45 milliliters of 20 percent aqueous NEOGEN R™ solution were added. Subsequently, the mixture was heated to 93° C. and held there for a period of 4 hours before cooling down to about 50° C. After addition of 2.20 grams of zinc sulfate heptahydrate, the pH of the reaction mixture was adjusted to be above 9 by addition of aqueous potassium hydroxide solution before a solution of 2.98 grams of 3,5- diiodosalicylic acid and 1.0 gram of 85 percent potassium hydroxide in 45 milliliters of water was added. The reaction mixture was stirred at 85° C. for 1 hour and filtered. The toner was washed four times with water and freeze dried. The resulting toner comprised of resin, pigment, and on the toner surface charge control entities derived from the reaction of zinc sulfate and 3,5-diiodosalicylic acid, evidenced a particle size of 6.9 microns in volume average diameter and a GSD of 1.19 as measured with a Coulter Counter. The tribo values of the toner as evaluated according to the procedure of Example I were −26.4 μC/g and −11.7 μC/g at, respectively, 20 and 80 percent relative humidity.

Other modifications of the present invention may occur to those of ordinary skill in the art subsequent to a review of the present application, and these modifications, including equivalents thereof, are intended to be included within the scope of the present invention.

What is claimed is:

1. A process for the preparation of toner comprising (i) preparing, or providing an aqueous colorant dispersion, which dispersion is comprised of a colorant and an ionic surfactant in water;

(ii) blending said colorant dispersion with a latex emulsion comprised of resin particles, a nonionic surfactant, and an ionic surfactant of opposite charge polarity to that of the ionic surfactant in said colorant dispersion;

(iii) heating the resulting mixture below about the glass transition temperature (Tg) of the latex resin to form toner sized aggregates;

(iv) heating the resulting aggregate suspension of (iii) above about the Tg of the latex resin; and (v) retaining the temperature in the range of from about 30° C. to about 95° C., and subsequently, adding an aqueous solution of boric acid, or an aqueous solution of a metal salt; adjusting the pH of the resulting reaction mixture to from about 9 to about 12 by the addition of a base, followed by the addition of a salicylic acid or catechol; and optionally (vi) isolating, washing and drying the toner obtained.

2. A process for the preparation of toner comprising blending a colorant dispersion and a latex emulsion, and wherein the colorant dispersion contains an ionic surfactant, the latex contains a nonionic surfactant and an ionic surfactant of opposite charge polarity to that of ionic surfactant in the colorant dispersion; heating the resulting mixture whereby aggregates form; further heating said aggregate suspension; followed by adjusting the pH of the reaction mixture to be from about 9 to about 12; and then adding an aqueous solution of a metal salt, followed by the addition of a salicylic acid or a catechol; and optionally isolating, washing and drying the toner.

3. A process in accordance with claim 2 wherein there is accomplished a heating of the resulting mixture at a temperature of from about 30° C. to about 60° C. to effect formation of aggregates of a particle size of from about 2 to about 10 microns in volume average diameter; thereafter heating the formed aggregate suspension in the presence of a stabilizer agent to prevent, or minimize the aggregates from growing in size, which heating is at a temperature of from about 65° C. to about 105° C.; subsequently maintaining the temperature at from about 30° C. to about 90° C.; adding said base component to maintain the pH of the reaction mixture to be from about 9 to about 12; and then adding a metal salt of aluminum, zinc, or chromium, followed by the addition of said salicylic acid or catechol; and isolating the toner product.

4. A process in accordance with claim 1 wherein the product toner size is from about 2 to about 15 microns in volume average diameter, and wherein the particle size distribution of the aggregates is from about 1.12 to about 1.35.

5. A process in accordance with claim 1 wherein the surfactant in the colorant dispersion is a cationic surfactant, and the ionic surfactant present in the latex emulsion is an anionic surfactant.

6. A process in accordance with claim 1 wherein the surfactant in the colorant dispersion is an anionic surfactant, and the ionic surfactant present in the latex emulsion is a cationic surfactant.

7. A process in accordance with claim 2 wherein the ionic surfactant in the colorant dispersion is a cationic surfactant, and the ionic surfactant present in the latex emulsion is an anionic surfactant; or wherein the surfactant in the colorant dispersion is an anionic surfactant, and the ionic surfactant present in the latex emulsion is a cationic surfactant.

8. A process in accordance with claim 1 wherein the heating of the blend of latex, colorant, and surfactants in the aggregation (iii) is accomplished at a temperature of from about 15° C. to about 1° C. below the Tg of the latex resin for a duration of from about 0.5 hour to about 6 hours; and wherein the heating of the aggregate suspension in the coalescence (iv) forms integral toner particles comprised of resin, colorant, and surfactants, and on the toner surface a charge control agent functionality derived from the reaction of said boric acid or a metal salt with said salicylic acid or said catechol.

9. A process in accordance with claim 1 wherein the latex emulsion is generated from the emulsion polymerization of vinyl monomers selected from the group consisting of styrene and substituted styrenes, 1,3-dienes, acrylates, methacrylates, acrylonitrile, acrylic acid, and methacrylic acid.

10. A process in accordance with claim 1 wherein the latex resin is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate- isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid); and wherein the resin is optionally present in an effective amount ranging from 80 percent by weight to about 98 percent by weight of toner.

11. A process in accordance with claim 1 wherein the resin is selected from the group consisting of poly(styrene-butadiene-acrylic acid) poly(styrene-butadiene-methacrylic acid), poly(styrene-butyl methacrylate-acrylic acid), poly (styrene-butyl acrylate-acrylic acid), poly(styrene-butyl acrylate-acrylonitrile), poly(styrene-butyl acrylate-acrylonitrile-acrylic acid), and poly(styrene-butadiene-acrylonitrile-acrylic acid).

12. A process in accordance with claim 1 wherein the nonionic surfactant present in the latex emulsion is selected from the group consisting of polyvinyl alcohol, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; wherein the anionic surfactant is selected from the group consisting of sodium dodecyl sulfate, sodium dodecylbenzene sulfate and sodium dodecylnaphthalene sulfate, and wherein the ionic surfactant is a quaternary ammonium salt.

13. A process in accordance with claim 1 wherein the colorant is carbon black, magnetite, cyan, yellow, magenta, or mixtures thereof.

14. A process in accordance with claim 1 wherein the latex size is from about 0.05 to about 1 micron in average volume diameter; and the colorant particle size is from about 0.01 to about 1 micron in volume average diameter.

15. A process in accordance with claim 1 wherein the nonionic, anionic and cationic surfactants are each present in an amount of from about 0.01 to about 5 weight percent of the total reaction mixture.

16. A process in accordance with claim 1 wherein for the toner surface modification (v) there is selected a salicylic acid in an amount of from about 0.05 to about 5 percent by weight of toner and a metal salt of zinc or chromium in an amount of from about 0.05 to about 5 percent by weight of toner.

17. A process in accordance with claim 1 wherein for the toner surface modification (v) there is selected a catechol in an amount of from about 0.05 to about 5 percent by weight of toner and a metal salt of zinc or chromium in an amount of about 0.05 to about 5 percent by weight of toner.

18. A process in accordance with claim 1 wherein there is added to the surface of the formed toner metal salts, metal salts of fatty acids, silicas, metal oxides, or mixtures thereof in an amount of from about 0.1 to about 10 weight percent.

19. A process in accordance with claim 1 wherein the resin Tg is from about 45° C. to about 65° C.; wherein the latex resin is derived from emulsion polymerization of styrene, butyl acrylate, and acrylic acid; wherein the latex resin is derived from emulsion polymerization of styrene, butadiene, and acrylic acid; wherein the latex resin is derived from emulsion polymerization of styrene, butyl acrylate, acrylonitrile, and acrylic acid; or wherein the latex resin is derived from emulsion polymerization of styrene, butadiene, acrylonitrile, and acrylic acid.

20. A process comprising (i) mixing a colorant dispersion, which dispersion is comprised of a colorant and an ionic surfactant in water and a latex emulsion comprised of resin, a nonionic surfactant and an ionic surfactant of opposite charge polarity to that of the ionic surfactant in said colorant dispersion;

(ii) heating the resulting mixture below about the glass transition temperature (Tg) of the latex resin;

(iii) heating the resulting suspension of (ii) above about the Tg of the latex resin; and (iv) subsequently adding an aqueous solution of boric acid or a metal salt; adding a base, followed by the addition of a salicylic acid or catechol; and optionally (vi) isolating, washing and drying the toner obtained.

21. A process in accordance with claim 20 wherein a reaction is accomplished between the boric acid and carboxylic acid groups present on the toner surface, followed by the reaction of said boron ion with said added salicylic acid, or said catechol.

22. A process in accordance with claim 20 wherein a reaction is accomplished between the metal ion of said metal salt and carboxylic acid groups present on the toner surface, followed by the reaction of said metal ion with said added salicylic acid, or said catechol.

* * * * *